US008702090B2

(12) United States Patent
Geserich et al.

(10) Patent No.: US 8,702,090 B2
(45) Date of Patent: Apr. 22, 2014

(54) MODULAR PLACEMENT DEVICE OF A FEED STATION

(71) Applicants: Frank Geserich, Friedrichsthal (DE); Stefan Beckmann, Falkensee (DE)

(72) Inventors: Frank Geserich, Friedrichsthal (DE); Stefan Beckmann, Falkensee (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 0 days.

(21) Appl. No.: 13/656,942

(22) Filed: Oct. 22, 2012

(65) Prior Publication Data

US 2013/0106048 A1 May 2, 2013

(30) Foreign Application Priority Data

Oct. 31, 2011 (DE) ..... 20 2011 107 379

(51) Int. Cl.
*B65H 1/08* (2006.01)

(52) U.S. Cl.
USPC ..... 271/126; 271/131; 271/133; 271/165

(58) Field of Classification Search
USPC ..... 271/35, 126, 131, 165, 2, 149
See application file for complete search history.

(56) References Cited

U.S. PATENT DOCUMENTS

| | | | | | |
|---|---|---|---|---|---|
| 3,828,634 | A | * | 8/1974 | Luperti | 83/94 |
| 3,895,791 | A | | 7/1975 | Kramell et al. | |
| 3,948,506 | A | * | 4/1976 | Crimmins et al. | 271/165 |
| 3,977,668 | A | * | 8/1976 | Bologna et al. | 271/126 |
| 4,305,577 | A | * | 12/1981 | Clay et al. | 271/119 |
| 4,458,890 | A | * | 7/1984 | Kawazu | 271/37 |
| 4,624,453 | A | * | 11/1986 | Svensson | 271/4.07 |
| 5,954,324 | A | | 9/1999 | Rehberg et al. | |

FOREIGN PATENT DOCUMENTS

| | | |
|---|---|---|
| DE | 2717721 | 10/1978 |
| DE | 29823055 | 6/1999 |
| EP | 0023603 | 2/1981 |

* cited by examiner

*Primary Examiner* — Luis A Gonzalez
(74) *Attorney, Agent, or Firm* — Schiff Hardin LLP

(57) ABSTRACT

A modular placement device for a feed station of a mail processing apparatus, wherein the feed station includes an ejection roller, has a housing that is separate for the modular placement device located upstream, in terms of the mail flow, of the feed station. The housing has a cavity therein to receive a stack of mail items, and a pressure element mounted so as to be pivotable and so as to be plugged into the cavity. The pressure element exerts a pressure force on the stack of mail items in the cavity, with a bottommost item of mail being pressed against the ejection roller so that the bottommost item of mail is propelled in the mail flow direction. The weight loss of the stack due to removal of the bottommost item of mail therefrom is counteracted by the pressure element.

11 Claims, 5 Drawing Sheets

MODULAR PLACEMENT DEVICE OF A FEED STATION

BACKGROUND OF THE INVENTION

1. Field of the Invention

The invention concerns a modular placement device of a feed station. Such a feed station is an apparatus within a mail processing system that is equipped to feed mail pieces or flat goods to a printing apparatus. The invention is designed to simplify the feed station that is arranged upstream (in terms of the mail flow) of a peripheral apparatus (enveloping station, moistening/closing station, dynamic scale) or a printing apparatus. The modular placement device is required upstream (in terms of the mail flow) of a feed station without a placement region, and is suitable for use in a mail franking station in connection with a franking machine arranged downstream (in terms of the mail flow) of the feed station.

2. Description of the Prior Art

A system to frank mail shipments is known from DE 27 17 721. A stack of mail pieces that are stacked atop one another in an arbitrary order is placed in a magazine in the placement region. The stack is placed to the rear of a guide wall of the feed station, such that the edges of the mail pieces lie flush with the front side and rear side of the stack. The stack is situated at the start of a transport path and presses the lowermost mail piece against a feed deck. The lowermost mail piece forms the start of the stack and should first be isolated in the transport direction. To assist with the isolation, a wedge is applied to the stack from the left (upstream side). The surface of the wedge forms a sloped plane with an angle of inclination relative to the horizontal plane of the feed deck. A downhill slope force (grade) that is dependent on the cosine of the angle of inclination and the weight of the stack acts in the transport direction along the sloped plane. It is disadvantageous that the angle of inclination must be large enough and the letter length must be adjusted accordingly, or that the downhill slope force must be set dependent on the length of the mail piece. This hinders the feed for what is known as mixed mail, i.e. a mail stack with mail pieces of respectively different formats and thicknesses. An interference-free effect of the wedge also requires a defined minimum weight of the stack or of the mail pieces as well as a certain rigidity of the mail pieces so that their curvature is slight. Given an interference-free effect of the wedge at the right side of the stack, the edge of the lowermost mail piece projects the farthest, is thus engaged first and is pulled from the stack.

A device to isolate flat articles of different thickness and size from a stack is known from the German Utility Model DE 29823055 U1. The device is essentially subdivided into a placement region and into an ejection region, which follows the placement region to the right in the transport direction. Adjoining the placement region to the left is a wedge-shaped stack receptacle, and to the right a stack stop. A removal device in the ejection region has a height-adjustable retaining means and ejection rollers. A stack of flat goods (mail pieces) to be printed presses the lowermost mail piece in the placement region at the start of the transport path against the feed deck. If the stack is inclined and high enough, the contact pressure force exerted by the weight of the upper mail pieces on the lowermost mail piece contributes to an isolation (separation) of the lowermost mail piece. Interruptions in the isolation can occur, however, if the contact pressure is too high or if, in spite of a suitable stack height, the mail piece is only insufficiently pressed against the feed deck. Such disruption of the passage of the flat goods should be avoided or be simple to remedy.

In the German Patent DE 196 05 017 C2, an arrangement to pre-isolate print media is disclosed that breaks up the stack by means of projections at a drive roller its rotation. Since the arrangement also has a spring-biased pressure hoop that presses the stack of mail pieces against a guide plate, due to the spring pressure between the mail pieces a stiction (static friction) occurs that counteracts relative motion between the mail pieces. Upon reaching the maximum retention force, the relative motion is prevented. This retention forces:

$$F_{Rmax}=\mu_H \cdot F \tag{1}$$

with an elastic force F and with a coefficient of friction $\mu_H$ that depends on the material properties or the surface condition of the mail pieces. The elastic force of a spring is proportional to its deflection. The stiction therefore increases with the height of the stack, i.e. the more that the pressure clip is deflected, thus is spaced from the guide plate. The maximum retention force is achieved even before the pressure clip is maximally deflected. By loosening the stack, the stiction is temporarily overcome so that the individual mail pieces can easily be drawn from the stack. Loosening of the stack is superfluous given a low stack height of mail pieces of the same format. The cost for an actively operating device, which requires an actuator for a pre-isolation via drive rollers, is disadvantageous. However, a pressing on the stack is required if mixed mail, or even bulky or twisted mail pieces are included in the stack. The non-uniform pressure force is disadvantageous during the processing of the stack by the isolation of the mail pieces, in which case the pressure force increases with the stack height.

In a franking system with the Ultimail franking machine that is commercially available from Francotyp-Postalia, an automatic feed station is used for stacks of mail pieces lying on their back sides. The recommended maximum stack height is 50 mm. Given a higher stack level, a stiction can occur between the mail pieces, which in individual cases prevents an isolation. 30 to 40 mail pieces per stack can be anticipated. For example, the mail pieces are enveloped letters with the C6 envelope format in terms of length and with an average weight of 20 g per piece. A total weight of 600 g to 800 g therefore results for a stack with maximum stack height.

SUMMARY OF THE INVENTION

An object of the invention is to provide a modular placement device of a feed station that acts passively. The placement device should exert a pressure force on the stack at the transition to the ejection region of the feed station, which pressure force acts independently of the length of the item (mail piece) to be isolated, with the pressure force decreasing with growing stack height. The feed station should also enable a manual placement.

The modular placement device in accordance with the invention is stationed upstream (in terms of the mail flow) of the feed station in order to place a stack of items to be isolated at the feed station, which feed station isolates the items and transports them further in a transport direction. For this purpose, in a known manner the feed station has a draw device in the ejection region and a retention device for the stack. The draw device has at least one driven ejection roller that has a rotation axis oriented orthogonally to the transport direction. A stack of flat items to be printed presses the lowermost item in the placement region at the start of the transport path against a feed deck of the modular placement device. A higher weight of the stack is normally assumed in the case of a high stack compared to a lower stack. Rollers that reduce the friction resistance are provided in the feed deck. The modular placement device has a separate housing and a pressure element, mounted so that it can pivot, that can be inserted into a cavity of the housing near the rear wall of the modular placement device. This pressure element exerts a pressure force on the stack at the transition to the ejection region; causing the lowermost item to be pressed with such a force against at least one driven ejection roller of the feed station so that a propulsion of the item is achieved; with the weight loss of the stack due to the removal of the items for isolation of the stack being counteracted. In the case of similar items—for example mail pieces of the same format—the aforementioned force can be in the range from a minimum height of the stack to a maximum height of the stack, nearly independent of the stack height, or it can at least be within a predetermined force range. Defined conditions thereby exist for the removal of the lowermost item from the stack. The effect of the weight of the stack (this weight being reduced upon the removal) on the at least one driven ejection roller is at least partially compensated by the pressure element because its pressure force increases with decreasing stack height. Virtually no disruptions in the processing of the stack occur in a range between a maximum height of the stack and a minimum height of the stack, the flat items (mail pieces) of which that are to be isolated have an average weight. A stack with flat items to be isolated can now be processed without interruption, and therefore quickly.

The pressure element has a pendulum that can be attached to a pendulum support and a bearing shell that is designed so that it can be plugged into a cavity of the housing near the rear wall of the modular placement device. The pendulum support is mounted so that it can pivot on the bearing shell. The pendulum of the pressure element has two pendulum arms that are arranged at an angle $\delta<180°$ (advantageously in a range from 110° to 140°) relative to one another. The aforementioned angle is an internal angle at the lower pendulum part. One of the two pendulum arms is longer than the other and is designed to push the stack down. Both pendulum arms are connected with another by a middle part and are antiparallel to one another. The pendulum is designed as a two-part pendulum body with a lower pendulum part and an upper pendulum part, so that it can be assembled. The possibility exists to accommodate a material with a high specific weight in the pendulum body. The pendulum can be attached to or permanently connected with the pendulum support at the lower pendulum part, on the side of the short pendulum arm.

The feed deck of the modular placement device can be placed on a ramp. Moreover, to align the stack the modular placement device has an extendable slider mounted on the feed deck at the front side of the housing. This slider can subsequently be pressed against the stack, and a guide plate opposite the slider, the guide plate being permanently connected with the housing.

Given a manual placement of individual goods (mail pieces) at the feed station, no placement device is required. The aforementioned modular placement device can therefore be designed so as to be coupled and uncoupled from the feed station.

DESCRIPTION OF THE PREFERRED EMBODIMENTS

Figure 1:
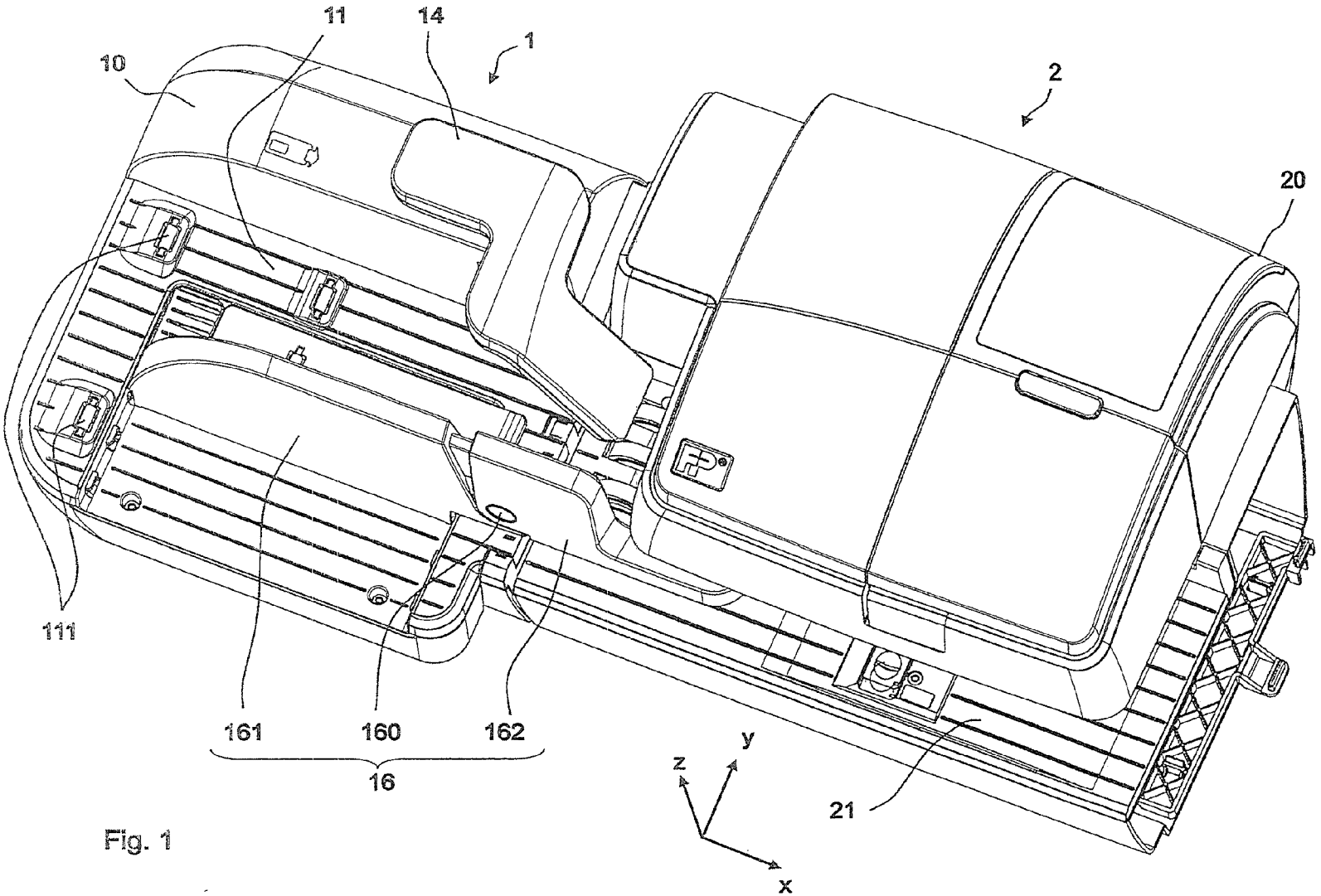
FIG. 1 is a perspective view of a feed station with a modular placement device in accordance with the invention.
Figure 6A:
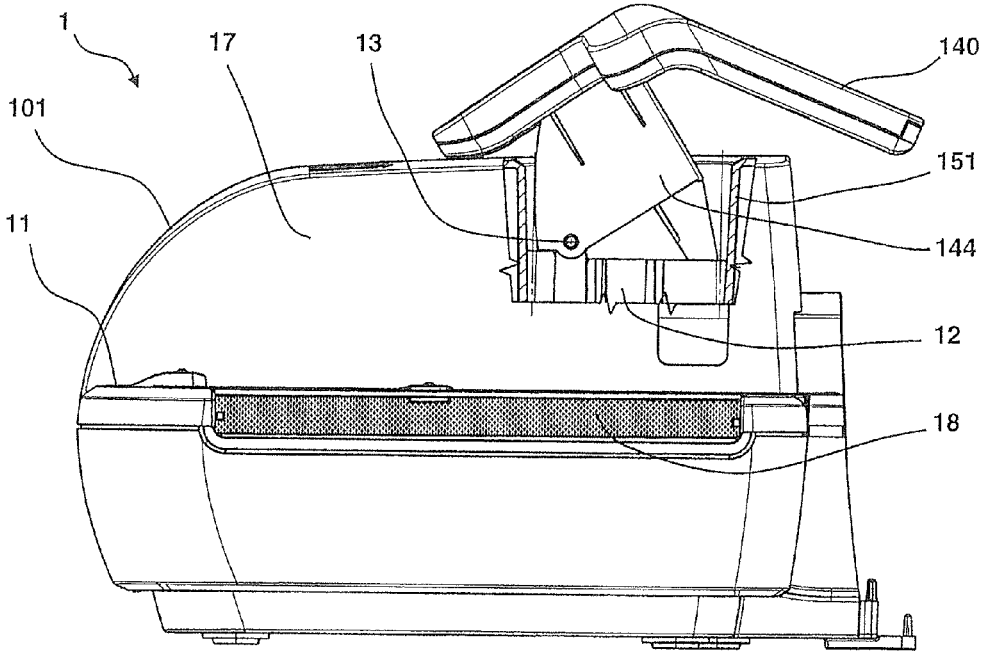
FIG. 6*a* is a front view of the placement device with pendulum but without slider, in accordance with the invention.
Figure 6B:
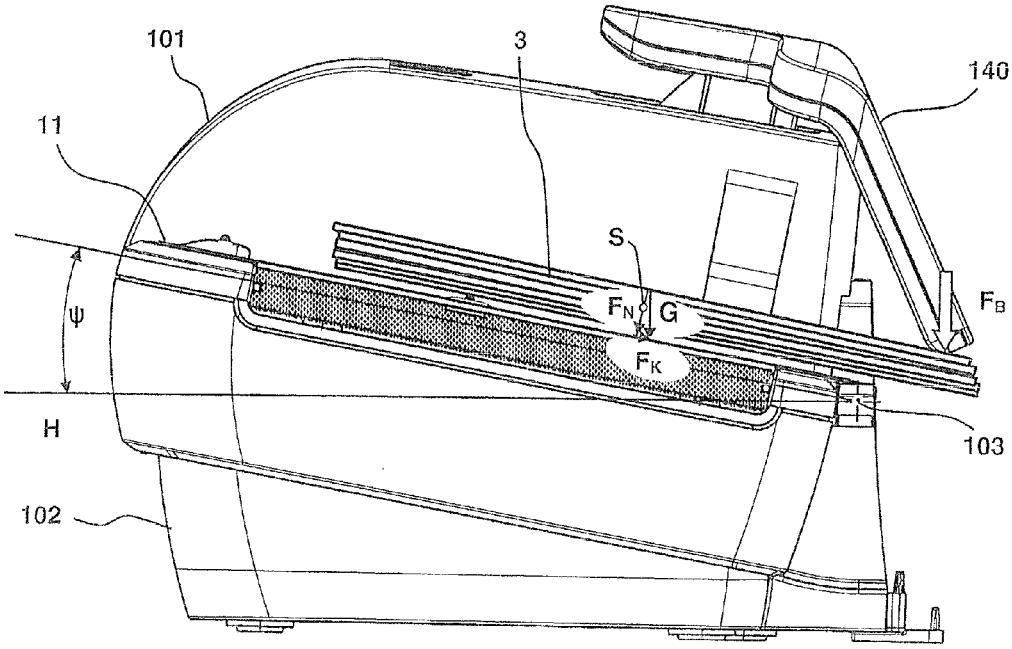
FIG. 6*b* is a front view of the placement device with pendulum and a feed deck set up as a ramp, without slider, in accordance with the invention.

FIG. 1 shows a perspective view of a feed station with a modular placement device. The modular placement device 1 has a housing 10 with a feed deck 11 and a placement element 14. The placement element 14 is realized as a pendulum that is angled towards a stack (not shown) lying on the feed deck 11 and thus can exert a pressure on said stack. The rollers 111 in the feed deck 11 reduce the friction of the goods (mail pieces) with the feed deck. A slider 16 mounted so as to be able to slide on the feed deck 11 has a first slider wall part 161 and a second slider wall part 162 and a shaft 160 via which the slider wall part 161 can be screwed on opposite the slider wall part 161 when the feed deck is set up at a ramp (FIG. 6*b*). With the slider a stack can be manually pressed with its lateral edges onto the guide plate of the housing. The housing comprises an upper shell and a lower shell that is covered by the upper shell. A slit-shaped opening is molded in the upper shell, which opening is covered by the slider. The slider 16 is mounted on the feed deck together with a damping mechanism (not shown). Some of the goods to be isolated can be buckled, bent or compressed by the pressure, which is however gradually, automatically reversed after the manual operation via the damping mechanism arranged within the placement device. The modular placement device also has a coupling mechanism and an additional, passively acting mechanism (not shown) under the feed deck in order to arrest the feed deck (which can be set up at a ramp) at a desired angle or to release it again (not visible).

The feed station 2 follows the modular placement device 1 in the transport direction (direction x). The feed deck 21 of the feed station 2 has a width (extending in the y-direction from the front to a rear stop) and lies parallel to the x/y-plane, which forms a base surface. The superstructures of the feed station 2 extends perpendicularly to the base surface, i.e. in the z-direction. The mail piece width is determined by the widest mail piece and the height of the superstructures is determined by the maximum height of a mail piece that can presently still be isolated and transported. A container for sealing fluid, a moistener for flaps of envelopes and a closing device for envelopes can be included in the superstructures. The height of the feed deck 21 above the base surface is determined by the height of a transport device (not shown) for mail pieces that is installed in the feed station.

Figure 2:
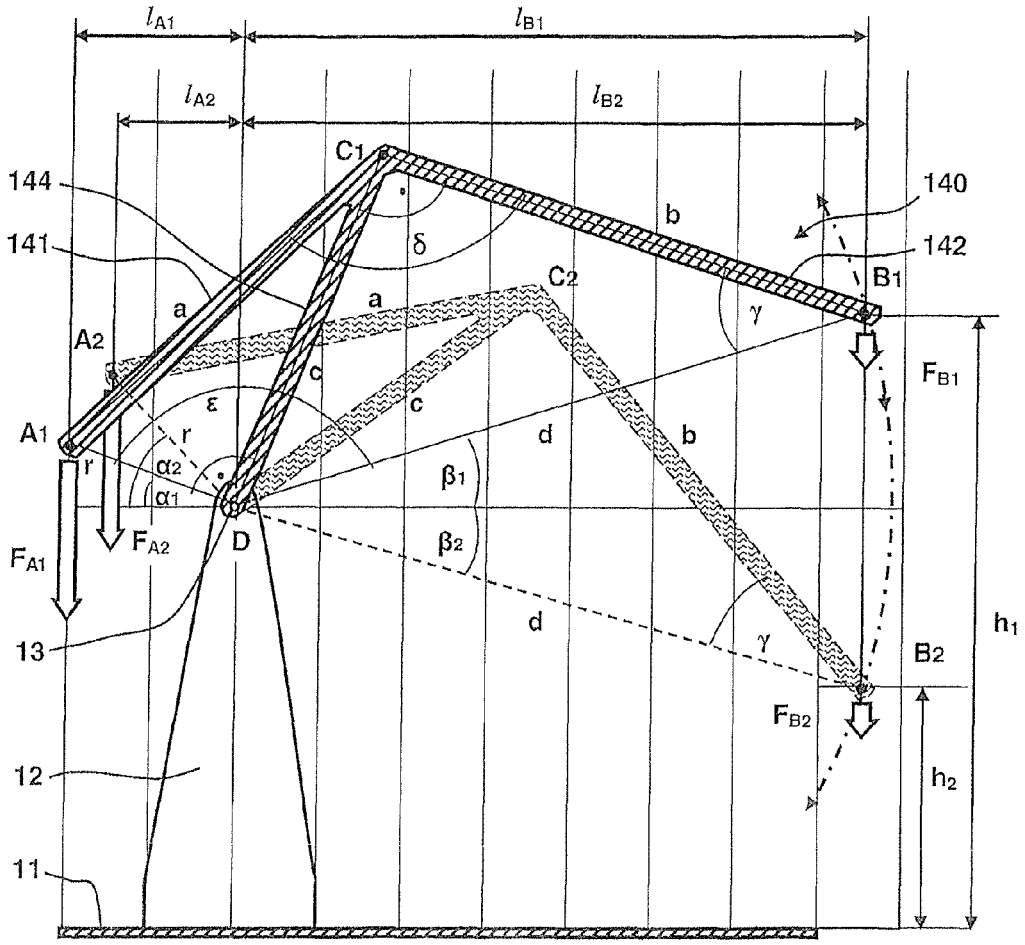
FIG. 2 shows an angle lever used in accordance with the invention.

FIG. 2 shows a basic illustration of an angle lever that can be constructed from two similar triangles with the points A1, C1, D and D, C1, B1 and has a pivot D. The distance A1-D thereby forms a lever arm with the radius r, and the distance B1-D forms a lever arm with radius d around the pivot D. The distance A1-C1 has a length a and is realized as a shorter pendulum arm 141 of a pendulum 140. The distance B1-C1 has a length b and is realized as a longer pendulum arm 142 of the pendulum 140. The distance C1-D has a length c and is realized as a pendulum support 144 that adjoins the internal angle δ of the pendulum 140 and reaches at least to the pivot D. The pivot D lies at a vertical distance above the feed deck 11 on a rotation axis that proceeds in a bearing or a bearing shell 12. A rotation axis 13 that is situated orthogonal to a vertical (z-direction) and orthogonal to a horizontal (transport direction x) travels through the pivot D. The angle (designated with a point) between the sides r and c or, respectively, c and b of the triangle can be a right angle or can be greater than 90°, up to approximately 110°. The sides a and c or, respectively, d and b of the triangle enclose an acute angle γ, for example γ=30°. After a leftward rotation of the pendulum 140 around the pivot D, the lever arm with the radius d reaches an angle $\beta_1$ (for example $\beta_1$=20°) while the lever arm with the radius r reaches an angle $\alpha_1$ (for example $\alpha_1$=25°). Weights (not shown) that exert respective forces $F_{A1}$ and $F_{B1}$ on the respective lever arms in the direction of gravity act at the ends A1 and B1 of the lever arms. A plot of the lever arm r on the horizontal yields a length $l_{A1}=r\cdot\cos\alpha_1$ that is effective for the gravitational force is shown in the upper part of FIG. 2. A plot of the lever arm on the horizontal yields a length $l_{B1}=d\cdot\cos\beta_1$ that is effective for the gravitational force and is likewise shown in the upper part of FIG. 2. If both arms of the pendulum 14 are at equilibrium, Hooke's Law applies:

$$F_{A1}\cdot l_{A1}=F_{B1}\cdot l_{B1} \tag{2}$$

Beyond the equilibrium, the pendulum tips in the direction of the arrow drawn with a dash-dot line. After a rightward rotation of the pendulum 140 around the pivot D, the lever arm with the radius d reaches an angle $\beta_2$ (for example $\beta_2$=−20°) while the lever arm with the radius r reaches an angle $\alpha_2$ (for example $\alpha_2$=50°). The weights (not shown) again act at the ends A2 and B2 of the lever arms r and d. A plot of the lever arm r on the horizontal yields a length $l_{A2}=r\cdot\cos\alpha 2$ that is effective for the gravitational force is shown in the upper part of FIG. 2. A plot of the lever arm r on the horizontal yields a length $l_{B2}=d\cdot\cos\beta_2$ that is effective for the gravitational force is likewise shown in the upper part of FIG. 2.

The effective length $l_{B2}=d\cdot\cos\beta_2$ is equal to the effective length $l_{B1}=d\cdot\cos\beta_1$. Although the weights have not changed, however, equilibrium no longer exists because the effective lengths have changed at the side of the pendulum arm 141, such that now:

$$r\cdot\cos\alpha 2=l_{A2}<l_{A1}=r\cdot\cos\alpha 1 \tag{3}$$

Figure 3A:
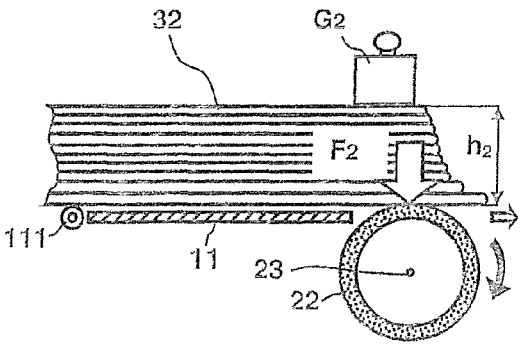
FIG. 3*a* shows a small stack upon isolation in accordance with the invention.

A small stack 32 upon isolation is presented in principle in FIG. 3*a*. The stack 32 with a height $h_2$ lies on rollers 111 of the feed deck 11 and on an ejection roller 22. The lowermost mail piece is pulled via a rotation of the driven ejection roller 22 around the rotation axis 21. The rotation direction is identified with a black arrow, and the ejection direction is identified with a white arrow. The longer pendulum arm (not shown) presses on the stack 32 with a weight G2. The sum of the weight G2 and the weight of the stack add up to a force F2. The force F2 acts on the ejection roller 22.

Figure 3B:
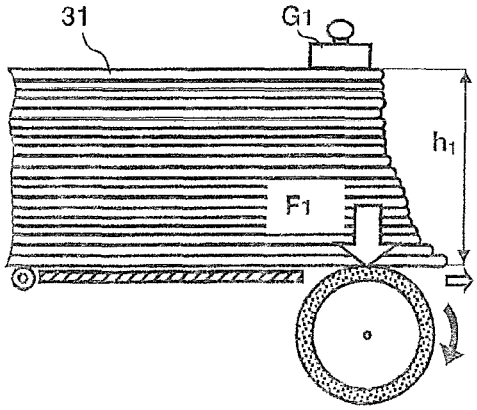
FIG. 3*b* shows a large stack upon isolation in accordance with the invention.

A large stack 31 upon isolation is presented in principle in FIG. 3*b*. If the weight of the longer pendulum arm is greater, such that both arms of the pendulum 140 are not in equilibrium, a weight G1 likewise acts on a stack 31 that rests on the feed deck and thus on the ejection roller. The sum of the weight G2 and the weight of the stack add to a force F1. The force F1 acts on the ejection roller, but with the difference that the weight G1 is smaller than the weight G2, and that the stack 31 with the height $h_1$ is higher than the height $h_2$ of the stack 32.

Figure 4A:
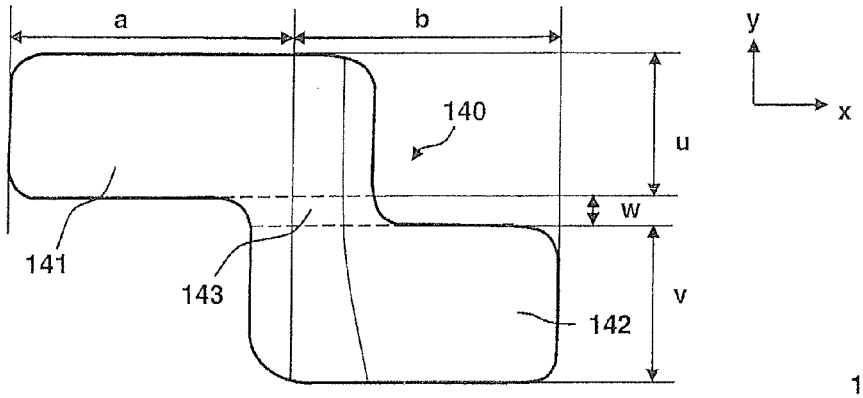
FIG. 4*a* is a plan view of a pendulum in accordance with the invention.

FIG. 4*a* shows a plan view on a pendulum 140 with the shorter lever arm 141 of the length a and with the longer pendulum arm 142 of the length b, as well as with a middle part 143 of the pendulum. The shorter pendulum arm 141 has the width u and the longer pendulum arm 141 has the width v. Both pendulum arms are situated antiparallel to one another and are separated in width by the middle part 143 of the pendulum, wherein the distance w is smaller than the width u or the width v.

Figure 4B:
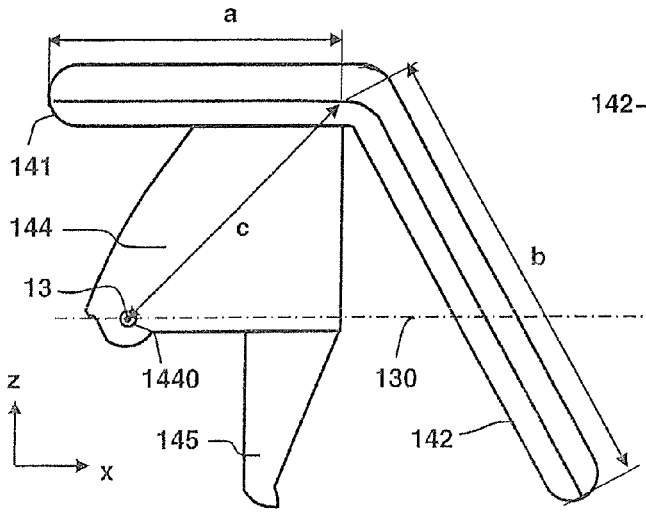
FIG. 4*b* is a view of the pressure element from the front, in accordance with the invention.

FIG. 4*b* shows a view of the pressure element from the front. The surface of the pendulum support 144 lies parallel to the x/z-plane and, to the left of the center, has a circular opening 1440 around a pivot 13. A catch 145 is molded toward the bottom on the pendulum support 144. The pendulum arm 142 strikes the pendulum arm 141 at an angle at an impact point. A diagonal between the pivot 13 and the impact point has a length c. The shorter pendulum arm 141 of length a lies parallel to the x-direction, and the longer pendulum arm 142 of length b lies at an angle to the x-direction.

Figure 4C:
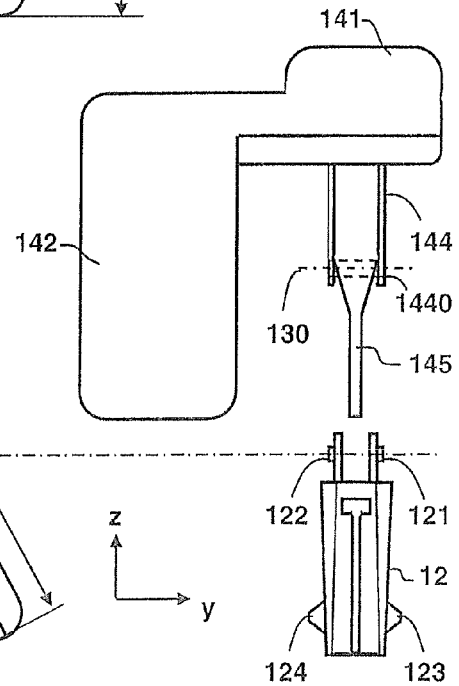
FIG. 4*c* is a view of the pressure element and a bearing shell from the left, in accordance with the invention.

A view from the left of the pressure element and of a bearing shell is shown in FIG. 4*c*, wherein the bearing shell 12 is designed to bear the pendulum support 144 and is provided to be plugged into the bearing shell 12 in a shaft-shaped cavity (not shown) of the housing of the placement device. The bearing shell 12 has bearing pins 121, 122 molded on both sides so as to be elastic to support the pendulum support, and has elastically formed detents 123, 123 for insertion into the shaft-shaped cavity. The pendulum support 144 is molded on the lower part of the pendulum arm 141. The pendulum arm 142 is molded at an angle on the pendulum arm 141. The pendulum support 144 has circular openings 1440 with a diameter correspondingly matched to the diameter of the bearing pins 121, 122 and a catch 145. The pendulum support 144 is mounted on the bearing shell 12 so that the bearing pins 121, 122 and openings 1440 lie on a rotation axis 130.

Figure 5:
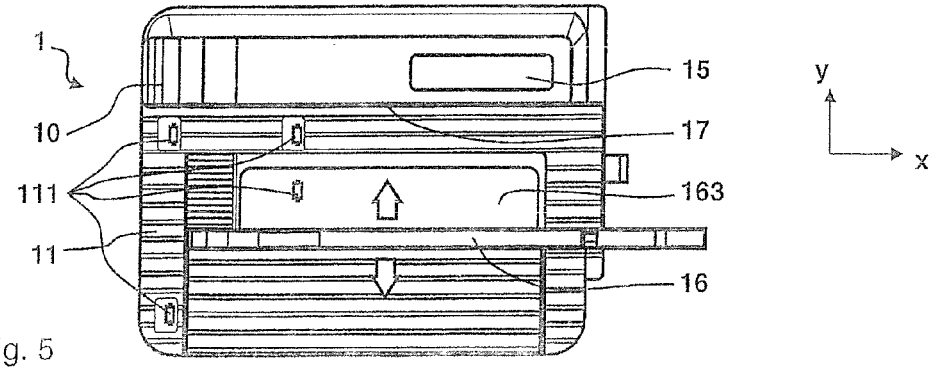
FIG. 5 is a plan view of the housing of the placement device without pendulum, in accordance with the invention.

FIG. 5 shows a plan view of the top shell 101 of the housing of the placement device 1 without the pendulum. In its upper shell 101 the housing has a shaft-shaped cavity 15 extending in the x-direction, near the right side wall and the rear wall. A guide wall 17 is provided parallel to the rear wall of the upper housing shell 101, the distance of which guide wall 17 from the rear wall is co-determined corresponding to the width (extending in the y-direction) of the shaft-shaped cavity 15. A feed deck 11 is arranged at a distance from a base plate, which feed deck 11 includes rollers 111 in order to reduce the friction resistance caused by stiction. A slider 16 arranged so that it can be displaced in the y-direction on the feed deck 11 has a slider plate 163 that is molded on the slider wall part 161. This allows a stack to be displaced up to a stop on the guide wall 17. The front view of the placement device 1 that is shown in FIG. 6*a* includes the pendulum 140 moved away from the operating position and the upper housing shell 101, which—together with the feed deck 11—is placed back in the horizontal plane. The slider has been removed in order to enable a view of the guide wall 17 at the housing 10. A slit-shaped opening 18 on the front side is provided for the insertion of the slider. The guide wall 17 is drawn in section in order to enable a view of the bearing shell 12 mounted in the housing. The cavity is drawn in section in order to show the shaft wall 151, the pendulum support 144 inserted into the bearing shell 12, and the pivot 13 of the pivot 140. The pendulum rotation to the left is stopped in that the catch of the pendulum support 144 stops at the inner bearing shell wall.

This pendulum setting stably persists, which is advantageously usable for insertion of a stack into the placement device.

A front view of the placement device with a pendulum 140 in the operating position and a feed deck 11 set up as a ramp is shown in FIG. 6*b*. The feed deck 11 can be set up together with the upper housing shell 101 up to an angle of $\psi_{max}=10°$. The pivot 103 of the upper housing shell 101 lies on a horizontal line H on the right size. The lower housing shell 102 lies below the horizontal line H. A stack 3 of mail pieces lies on the feed deck. The weight G of the stack 3 or mail piece acts near the center of gravity and—due to the gravitation—orthogonal to the ramp. The value of a normal force component $F_N$ and a downhill slope force component $F_K$ is dependent on the weight G of the stack 3 or mail piece, wherein said normal force component $F_N$ is situated orthogonal to the surface of the ramp, and wherein said downhill slope force component $F_K$ lies on the surface of the ramp and is directed downward in terms of the slope. The friction force $F_R$ increases with the normal force component $F_N$. The downhill slope force component is usable to propel the goods to be isolated. Given an increasing slope—i.e. an angle ψ of the surface of the ramp relative to the horizontal—the normal force component $F_N$ decreases and the downhill slope force component $F_K$ increases, wherein the formulas apply:

$$F_N=G\cdot\sin(90°-\psi) \quad (4)$$

$$F_K=G\cdot\cos(90°-\psi) \quad (5)$$

The pendulum 140 presses on the stack 3 with a force $F_B$ with the end of the longer pendulum arm in the transition region to the feed station.

Figure 6C:
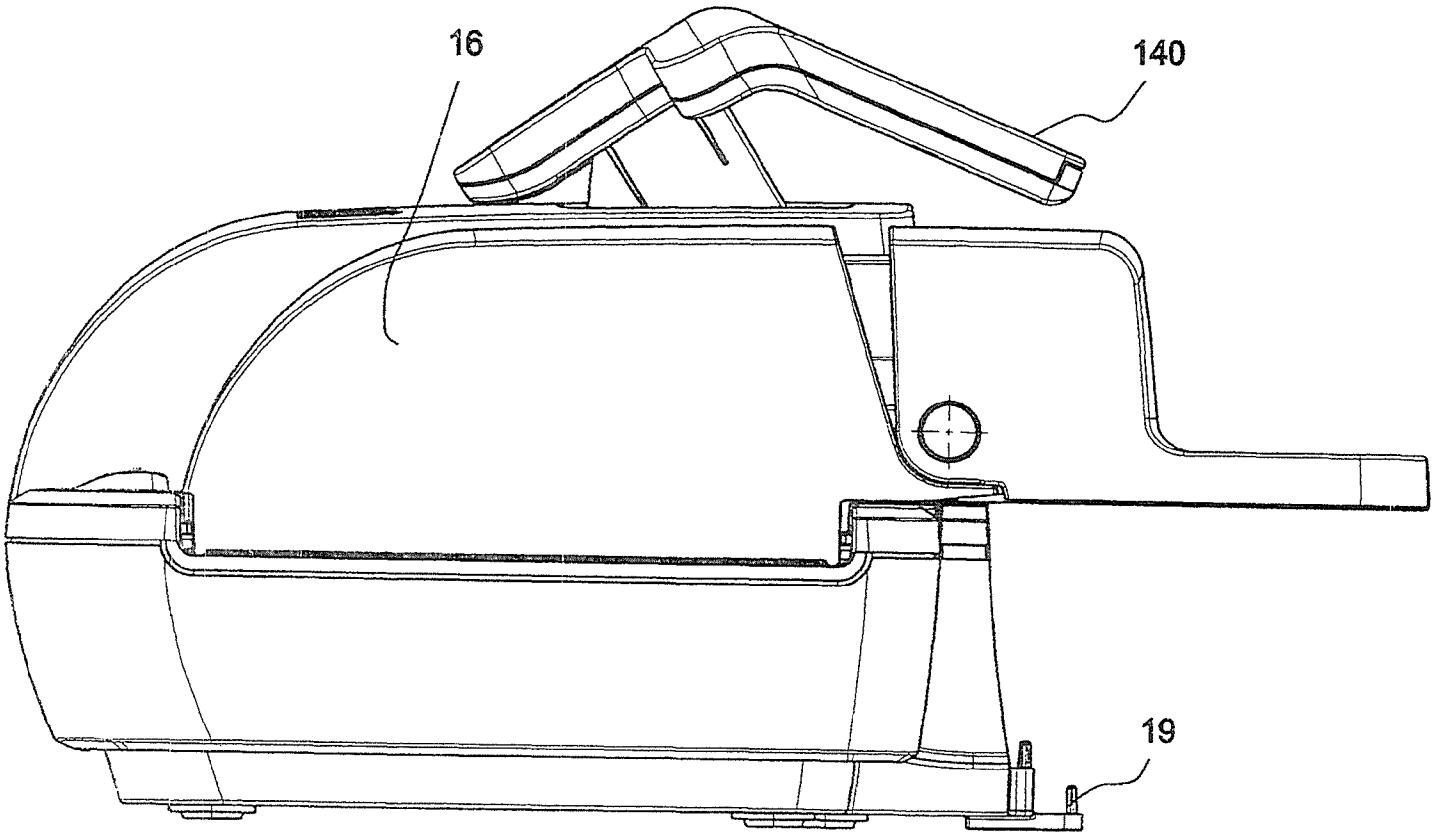
FIG. 6*c* is a front view of the placement device with slider in accordance with the invention.

FIG. 6*c* shows a front view of the placement device with slider 16 and with a pendulum 140 that is moved away from the stack covered by the slider, as well as with a coupling mechanism 19 to couple the placement device with a feed station (not shown) that follows downstream (in terms of the flow) in a franking machine.

Although modifications and changes may be suggested by those skilled in the art, it is the intention of the inventors to embody within the patent warranted hereon all changes and modifications as reasonably and properly come within the scope of their contributions to the art.

We claim as our invention:

1. In an apparatus for processing items of mail initially located in a stack of said items of mail, having a feed station with an item removing device comprising an ejection roller operable to remove an item of mail from said stack in a mail flow direction, the improvement of a modular placement device comprising:

a separate modular placement device housing, only for said modular placement device, located upstream, with respect to said mail flow direction, of said feed station;

said housing comprising a rear wall with a cavity adjacent to said rear wall;

a pressure element mounted to pivot and being configured to be plugged into said cavity;

said pressure element being configured to exert a pressure force on said stack in said feed direction that causes a bottommost item of mail in said stack to be pressed against said ejection roller to cause said ejection roller to propel said bottommost item of mail from said stack in said mail flow direction; and said pressure element being configured to change said pressure force by an amount that is dependent on a loss of weight of said stack due to removal of said bottommost item of mail therefrom, to counteract said loss of weight.

2. A modular placement device as claimed in claim 1 wherein said housing comprises an upper housing shell, and wherein said pressure element comprises a pendulum mounted to a pendulum support and a supporting shell configured to be plugged into said cavity in said upper housing shell adjacent to said rear wall, said pendulum support being mounted in order to pivot on said upper bearing shell, said pendulum comprising two pendulum arms connected to each other via a middle pendulum part, and located on opposite sides of said middle part.

3. A modular placement device as claimed in claim 2 wherein said pendulum arms are oriented with respect to each other at an angle of less than 180 degrees, said angle being formed as an internal angle at a lower part of said pendulum, and wherein a first of said two pendulum arms is longer than a second of said two pendulum arms, and presses downwardly on said stack in said cavity.

4. A modular placement device as claimed in claim 3 wherein said angle is in a range between 110 degrees and 140 degrees.

5. A modular placement device as claimed in claim 2 wherein said pendulum is connected to said lower pendulum part at a side of said second of said pendulum arms, by said pendulum support.

6. A modular placement device as claimed in claim 1 wherein said pressure element comprises a pendulum having a two-part pendulum body with a lower pendulum part and an upper pendulum part assembled together.

7. A modular placement device as claimed in claim 1 wherein said pressure element comprises a pendulum having a pendulum body, said pendulum body being configured to accommodate a material therein having a high specific weight.

8. A modular placement device as claimed in claim 1 wherein said stack comprises items of mail having a same format, and wherein said modular placement device comprises a feed deck on which said stack rests, said feed deck comprising rollers therein facilitating movement of said items of mail.

9. A modular placement device as claimed in claim 8 wherein said feed deck is ramped and comprises a slider mounted on said feed deck to align said stack, said slider extending toward a front side of said housing, and said feed deck comprising a guide plate connected to said housing opposite said slider.

10. A modular placement device as claimed in claim 9 wherein said slider has a first slider wall part and a second slider wall part and a turning shaft allowing said first slider wall part to be moved downwardly relative to said second slider wall part to produce said ramping of said feed deck.

11. A modular placement device as claimed in claim 1 comprising a coupling mechanism configured to allow coupling and decoupling of said housing to said feed station.

* * * * *